US012484710B2

(12) United States Patent
Yang

(10) Patent No.: US 12,484,710 B2
(45) Date of Patent: Dec. 2, 2025

(54) FOLDABLE HIGHCHAIR

(71) Applicant: ZT (Fujian) Industrial Co., Ltd., Zhangzhou (CN)

(72) Inventor: Jianbo Yang, Zhangzhou (CN)

(73) Assignee: ZT (Fujian) Industrial Co., Ltd., Zhangzhou (CN)

( * ) Notice: Subject to any disclaimer, the term of this patent is extended or adjusted under 35 U.S.C. 154(b) by 131 days.

(21) Appl. No.: 18/231,274

(22) Filed: Aug. 8, 2023

(65) Prior Publication Data

US 2024/0049892 A1 Feb. 15, 2024

(30) Foreign Application Priority Data

Aug. 10, 2022 (CN) ..... 202222091395.3

(51) Int. Cl.

| | |
|---|---|
| ***A47D 1/02*** | (2006.01) |
| ***A47C 4/28*** | (2006.01) |
| ***A47D 1/00*** | (2006.01) |

(52) U.S. Cl.

CPC ..... *A47D 1/023* (2017.05); *A47C 4/286* (2013.01); *A47D 1/0081* (2017.05); *A47D 1/0085* (2017.05)

(58) Field of Classification Search

CPC ..... A47D 1/023; A47C 4/286

See application file for complete search history.

(56) References Cited

U.S. PATENT DOCUMENTS

| | | | | |
|---|---|---|---|---|
| 7,281,759 | B1 * | 10/2007 | Strong | A47D 15/006 297/487 |
| 7,393,050 | B2 * | 7/2008 | Li | A47D 1/008 297/148 |
| 10,905,242 | B1 * | 2/2021 | Flannery | A47D 1/02 |
| 11,166,570 | B1 * | 11/2021 | Flannery | A47D 1/023 |
| 2010/0072790 | A1 * | 3/2010 | Pleiman | A47D 1/0085 297/16.2 |

FOREIGN PATENT DOCUMENTS

| | | | | |
|---|---|---|---|---|
| CN | 201153747 | Y * | 11/2008 | A47C 4/286 |
| CN | 110772077 | A * | 2/2020 | A47D 1/0081 |
| CN | 216797152 | U * | 6/2022 | A47D 1/0081 |
| DE | 202008000017 | U1 * | 8/2008 | A47C 4/286 |
| GB | 2434529 | A * | 8/2007 | A47D 1/008 |
| GB | 2465987 | A * | 6/2010 | A47D 1/008 |
| WO | WO-2005112703 | A1 * | 12/2005 | A47C 4/286 |

* cited by examiner

*Primary Examiner* — Timothy J Brindley
(74) *Attorney, Agent, or Firm* — Bayramoglu Law Offices LLC

(57) ABSTRACT

A foldable highchair includes four support rods and a cloth seat. A hinge base and a slide base are sleeved on each of the four support rods. Two folding rods intersected with each other are arranged between the every adjacent two support rods, and the two folding rods are hinged at an intersection. One end of each of the two folding rods is hinged with the corresponding hinge base, and the other end of each of the two folding rods is hinged with the corresponding slide base. A double-locking mechanism configured to control the two folding rods to be fixed or folded is arranged on the two folding rods between the adjacent two support rods in one group. The cloth seat is connected to the four support rods, and a feeding tray is arranged between the tops of the front two support rods.

7 Claims, 8 Drawing Sheets

FOLDABLE HIGHCHAIR

CROSS REFERENCE TO THE RELATED APPLICATIONS

This application is based upon and claims priority to Chinese Patent Application No. 202222091395.3, filed on Aug. 10, 2022, the entire contents of which are incorporated herein by reference.

TECHNICAL FIELD

The utility model relates to the field of children's products, in particular to a foldable highchair.

BACKGROUND

Highchairs are special chairs for feeding children. Highchairs can help children develop the habit of sitting for eating, avoiding the trouble of chasing for feeding. Children can sit steadily in a suitable highchair, and their hands can be freed to grasp tableware, which exercises the coordination of children's hands, eyes, and brain. A prior highchair used by children includes a front bracket, a rear bracket, a seat, a backrest, a feeding tray, and other components. The front bracket and the rear bracket are foldable and configured to support the seat. The top of the front bracket and the top of the rear bracket are hinged by a button structure, and the button structure drives the front bracket and the rear bracket to be folded. However, the prior button structure is complex, time-consuming in assembly, and high in cost.

SUMMARY

The utility model provides a foldable highchair, mainly aiming at overcoming the above problems existing in the prior art.

The utility model is realized by adopting the following technical solutions:

A foldable highchair includes four support rods distributed at four corners and a cloth seat. A hinge base and a slide base are sleeved on each of the four support rods. The four support rods form four groups of adjacent two support rods. Two folding rods intersected with each other are arranged between the adjacent two support rods in each group, and the two folding rods are hinged at an intersection. One end of each of the two folding rods is hinged with the corresponding hinge base, and the other end of each of the two folding rods is hinged with the corresponding slide base. A double-locking mechanism configured to control the two folding rods to be fixed or folded is arranged on the two folding rods between the adjacent two support rods in one group. The slide base on each of the adjacent two support rods in the other group is provided with an opening slot, and an elastic column is arranged in each of the adjacent two support rods in the other group. One end of the elastic column extends out of the support rod and snaps into the opening slot. The cloth seat is connected to the four support rods, and a removable feeding tray is arranged between the tops of the front two support rods.

Further, the double-locking mechanism includes a first locking piece, a second locking piece, and a third locking piece arranged sequentially from inside to outside, One end of the first locking piece is hinged with one support rod, one end of the second locking piece is hinged with another support rod, and the other end of the first locking piece and the other end of the second locking piece are hinged with the third locking piece. The top surface of the first locking piece is provided with a cover piece. The third locking piece is in the shape of "]", and the bottom of the third locking piece is provided with an inclined hook portion. The bottom surface of the cover piece abuts the top surface of the second locking piece and the top surface of the third locking piece. The hook portion hooks on the bottom surface of the second locking piece, and the third locking piece is configured to be moved.

Further, the other end of the first locking piece is provided with a first hinge hole, and the other end of the second locking piece is provided with a second hinge hole. A transverse portion of the third locking piece is provided with a third hinge hole. The first locking piece, the second locking piece, and the third locking piece are hinged by allowing a pin shaft to pass through the first hinge hole, the second hinge hole, and the third hinge hole. The size of the third hinge hole is larger than the size of the first hinge hole and the size of the second hinge hole.

Further, an elastic button piece is arranged in the opening slot. A V-shaped elastic piece is arranged in each of the adjacent two support rods in the other group. The V-shaped elastic piece is provided with the elastic column, and the elastic column abuts the button piece.

Further, a limiting member is fixedly arranged on each of the four support rods, and the limiting member is located above the slide base.

Further, the feeding tray is configured to be adjusted in multiple front and rear positions.

Further, each of the tops of the front two support rods is provided with a bending rod, and a feeding tray base is sleeved on the outer periphery of the bending rod. The bottom of the feeding tray is fixedly provided with two button boxes with an opening at the top, and each button box corresponds to the feeding tray base on one bending rod, An elastic button is arranged in the button box, and the bottom of the button extends out of the bottom of the button box. Each of both sides of the feeding tray base is provided with a slide slot and two clamping slots arranged at an interval. The two clamping slots are located below the slide slot and are communicated with the slide slot. A side of the button box is provided with a guide rail and a notch, and the guide rail is located in the slide slot. A side of the button is provided with a clamping portion, and one end of the clamping portion passes through the notch and is located in the clamping slot.

Further, a spring groove is arranged in the button box, and the bottom of the feeding tray is provided with a spring sleeve column. A spring is arranged in the spring groove, and the top of the spring is sleeved on the outer periphery of the spring sleeve column. The inner peripheral surface of the button box is provided with a plurality of guide grooves, and the outer periphery of the button is provided with a plurality of guide bars. Each guide bar corresponds to one guide groove and is located in the guide groove.

Further, the rear end face of the cloth seat is provided with an accommodation slot into which the rear two support rods are allowed to extend. The front end of the cloth seat is provided with two rod holes through which the front two support rods are allowed to pass.

From the above description of the utility model, compared with the prior art, the utility model has the following advantages: the utility model is novel in structure and ingenious in design. When the highchair needs to be folded, the feeding tray is removed first, and the double-locking mechanism is operated to control the two folding rods to be in a folded state. Subsequently, the elastic column is pressed to separate from the opening slot. Finally, the slide base is grasped to slide down to fold the four support rods and the four groups of folding rods. As the four support rods are folded, the cloth seat is folded. The double-locking mechanism is adopted in the utility model to control the folding of the support rods and the folding rods, which simplifies the structure, decreases the cost, and reduces the assembly time and the production cost of the enterprise.

DETAILED DESCRIPTION OF THE EMBODIMENTS

Figure 1:
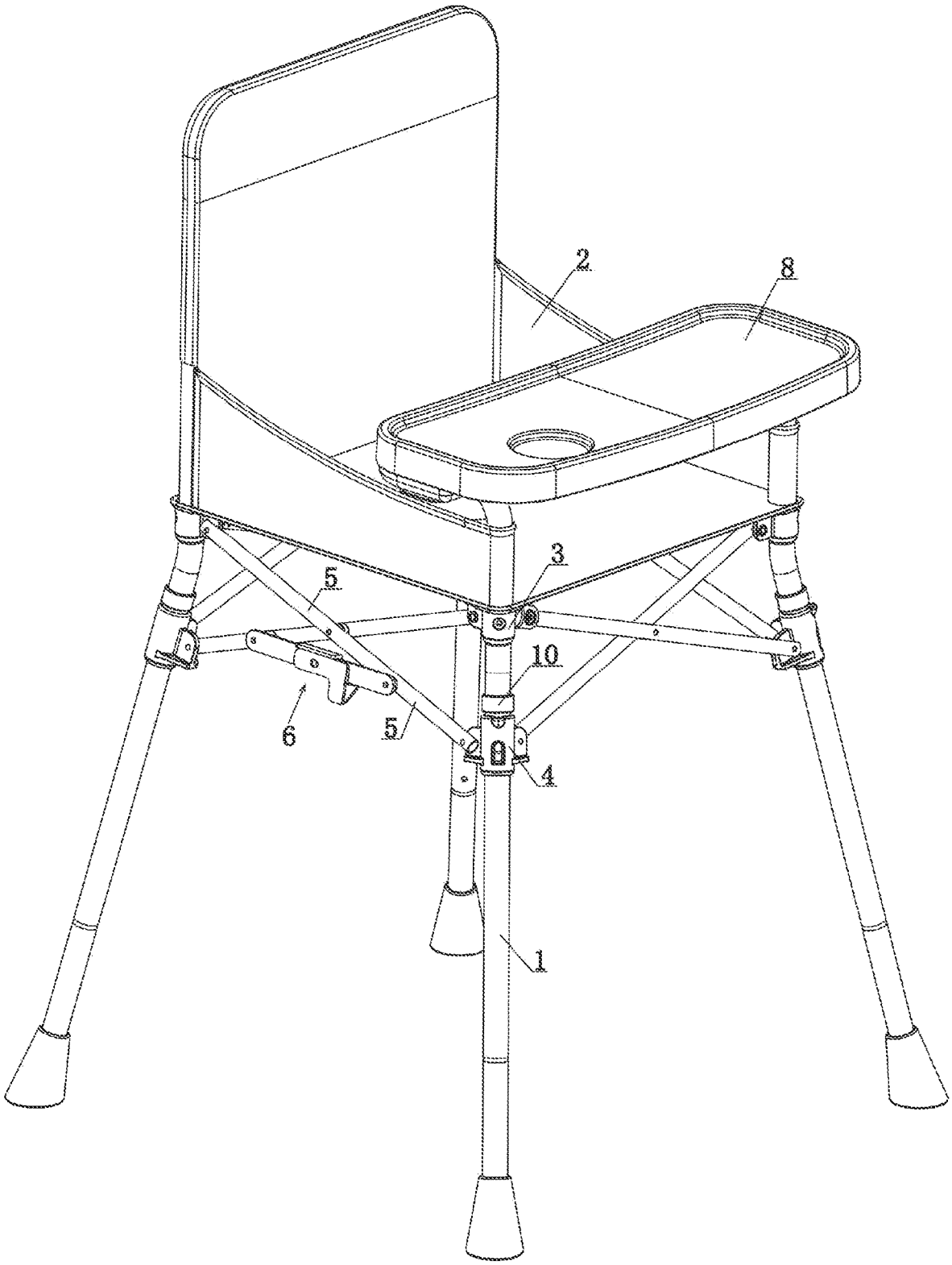
FIG. 1 is a structural diagram of the utility model.
Figure 4:
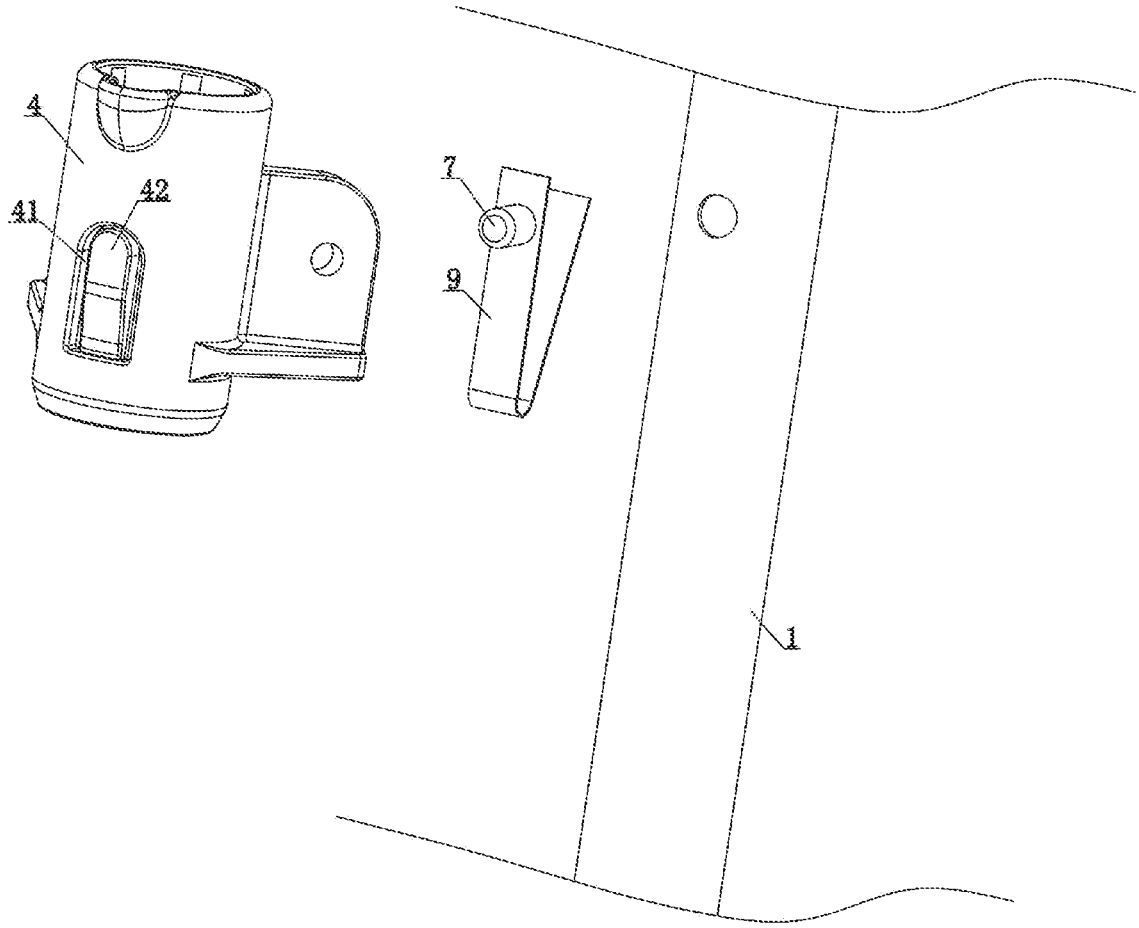
FIG. 4 is a structural decomposition diagram of a slide base and a support rod of the utility model.

Referring to FIGS. 1 and 4, a foldable highchair includes four support rods 1 distributed at four corners and the cloth seat 2. The hinge base 3 and the slide base 4 are sleeved on each of the four support rods 1. The four support rods 1 form four groups of adjacent two support rods 1. Two folding rods 5 intersected with each other are arranged between the adjacent two support rods 1 in each group, and the two folding rods 5 are hinged at the intersection. One end of each of the two folding rods 5 is hinged with the corresponding hinge base 3, and the other end of each of the two folding rods 5 is hinged with the corresponding slide base 4. The double-locking mechanism 6 configured to control the two folding rods 5 to be fixed or folded is arranged on the two folding rods 5 between the adjacent two support rods 1 in one group. The slide base 4 on each of the adjacent two support rods 1 in the other group is provided with the opening slot 41, and the elastic column 7 is arranged in each of the adjacent two support rods 1 in the other group. One end of the elastic column 7 extends out of the support rod 1 and snaps into the opening slot 41. The cloth seat 2 is connected to the four support rods 1, and the removable feeding tray 8 is arranged between the tops of the front two support rods 1.

Figure 2:
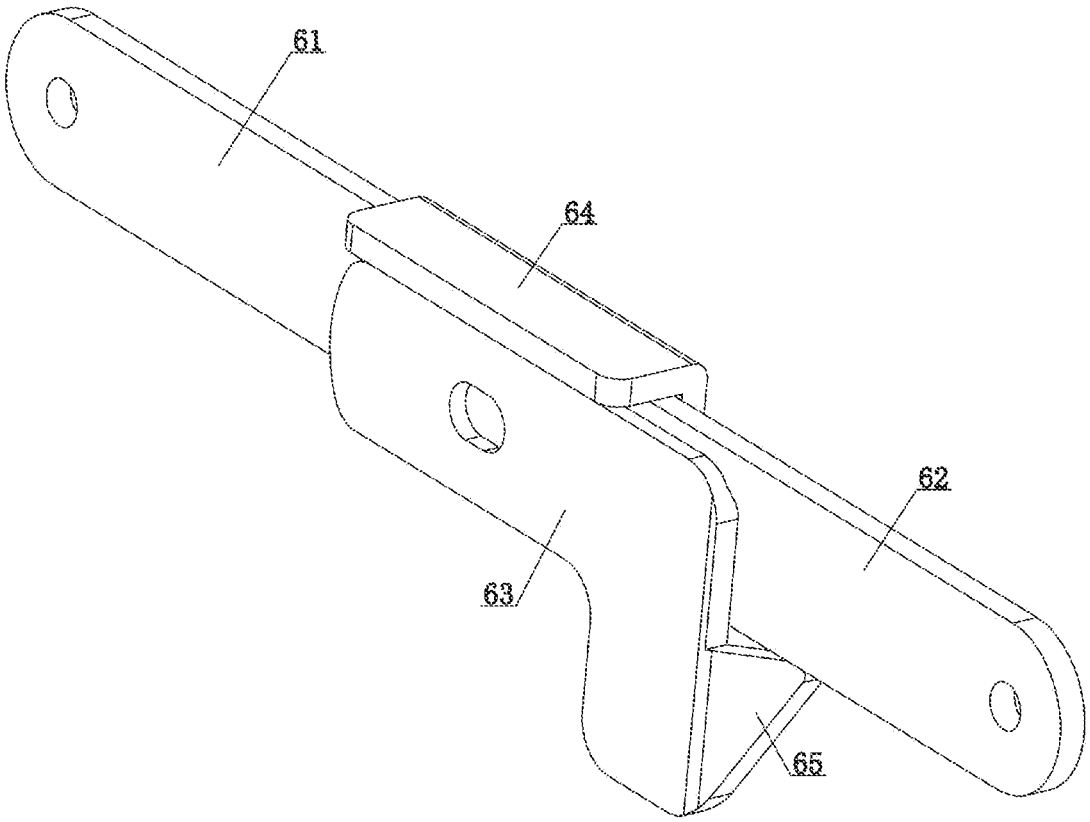
FIG. 2 is a structural diagram of a double-locking mechanism of the utility model.
Figure 3:
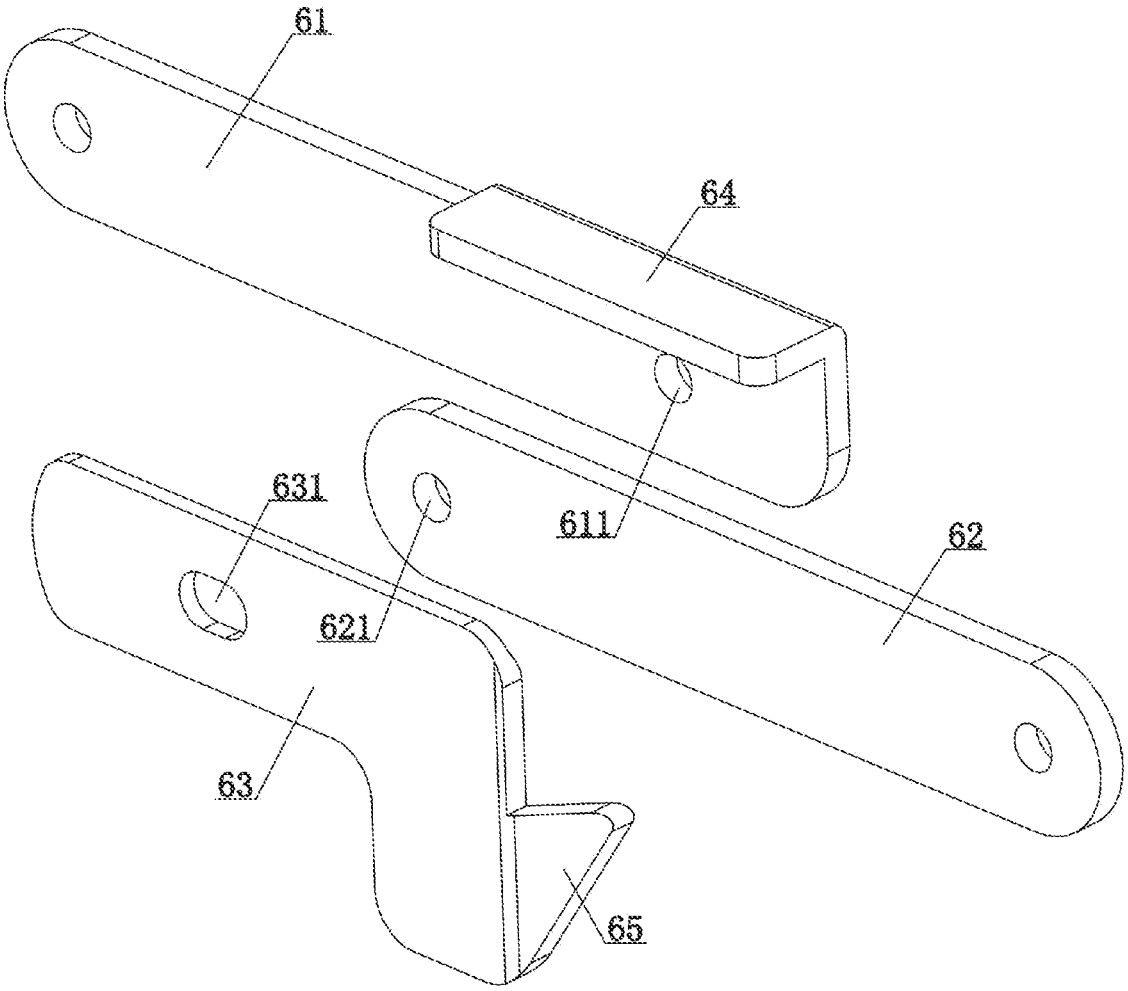
FIG. 3 is a structural decomposition diagram of the double-locking mechanism of the utility model.

Referring to FIGS. 1 to 3, the double-locking mechanism 6 includes the first locking piece 61, the second locking piece 62, and the third locking piece 63 arranged sequentially from inside to outside. One end of the first locking piece 61 is hinged with one support rod 1, one end of the second locking piece 62 is hinged with another support rod 1, and the other end of the first locking piece 61 and the other end of the second locking piece 62 are hinged with the third locking piece 63. The top surface of the first locking piece 61 is provided with the cover piece 64. The third locking piece 63 is in the shape of "]", and the bottom of the third locking piece 63 is provided with the inclined hook portion 65. The bottom surface of the cover piece 64 abuts the top surface of the second locking piece 62 and the top surface of the third locking piece 63. The hook portion 65 hooks on the bottom surface of the second locking piece 62, and the third locking piece 63 can be moved. The other end of the first locking piece 61 is provided with the first hinge hole 611, and the other end of the second locking piece 62 is provided with the second hinge hole 621. The transverse portion of the third locking piece 63 is provided with the third hinge hole 631. The first locking piece 61, the second locking piece 62, and the third locking piece 63 are hinged by allowing a pin shaft to pass through the first hinge hole 611, the second hinge hole 621, and the third hinge hole 631. The size of the third hinge hole 631 is larger than the size of the first hinge hole 611 and the size of the second hinge hole 621.

Referring to FIGS. 1 and 4, the elastic button piece 42 is arranged in the opening slot 41. The V-shaped elastic piece 9 is arranged in each of the adjacent two support rods 1 in the other group. The V-shaped elastic piece 9 is provided with the elastic column 7, and the elastic column 7 abuts the button piece 42. The limiting member 10 is fixedly arranged on each of the four support rods 1. The limiting member 10 is located above the slide base 4, and the limiting member 10 is configured to limit the upward sliding position of the slide base 4.

Referring to FIGS. 1, 2, 3, 4, and 9, when the highchair needs to be folded, the feeding tray 8 is first removed, and then the third locking piece 63 is moved outward to separate the hook portion 65 from the second locking piece 62. At this time, the two folding rods 5 are in a to-be-folded state. Subsequently, the button piece 42 is pressed to separate the elastic column 7 from the opening slot 41. Finally, the slide base 4 is grasped to slide down to fold the four support rods 1 and the four groups of folding rods 5. As the four support rods 1 are folded, the cloth seat 2 is folded.

Figure 5:
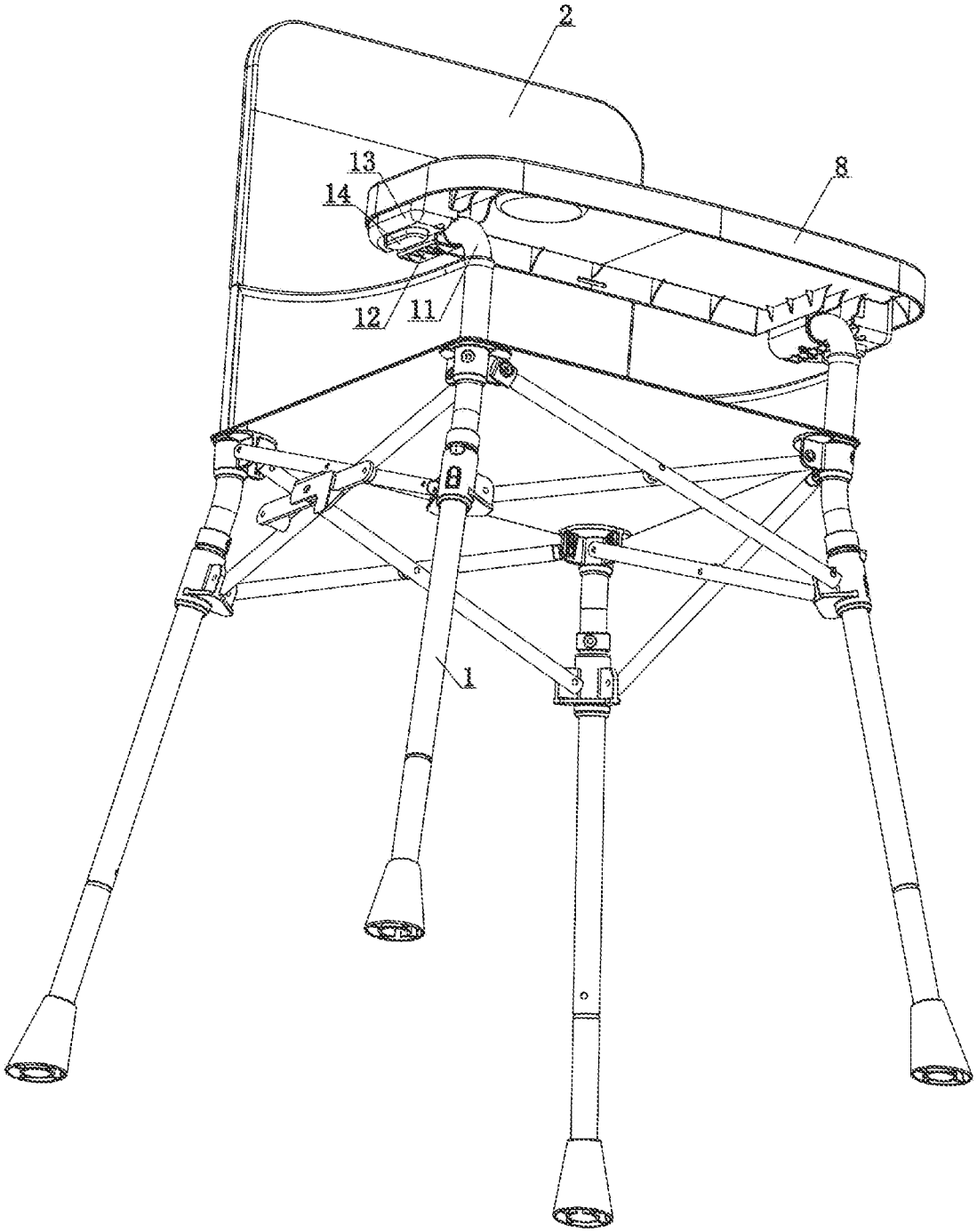
FIG. 5 is a perspective view of the utility model.
Figure 6:
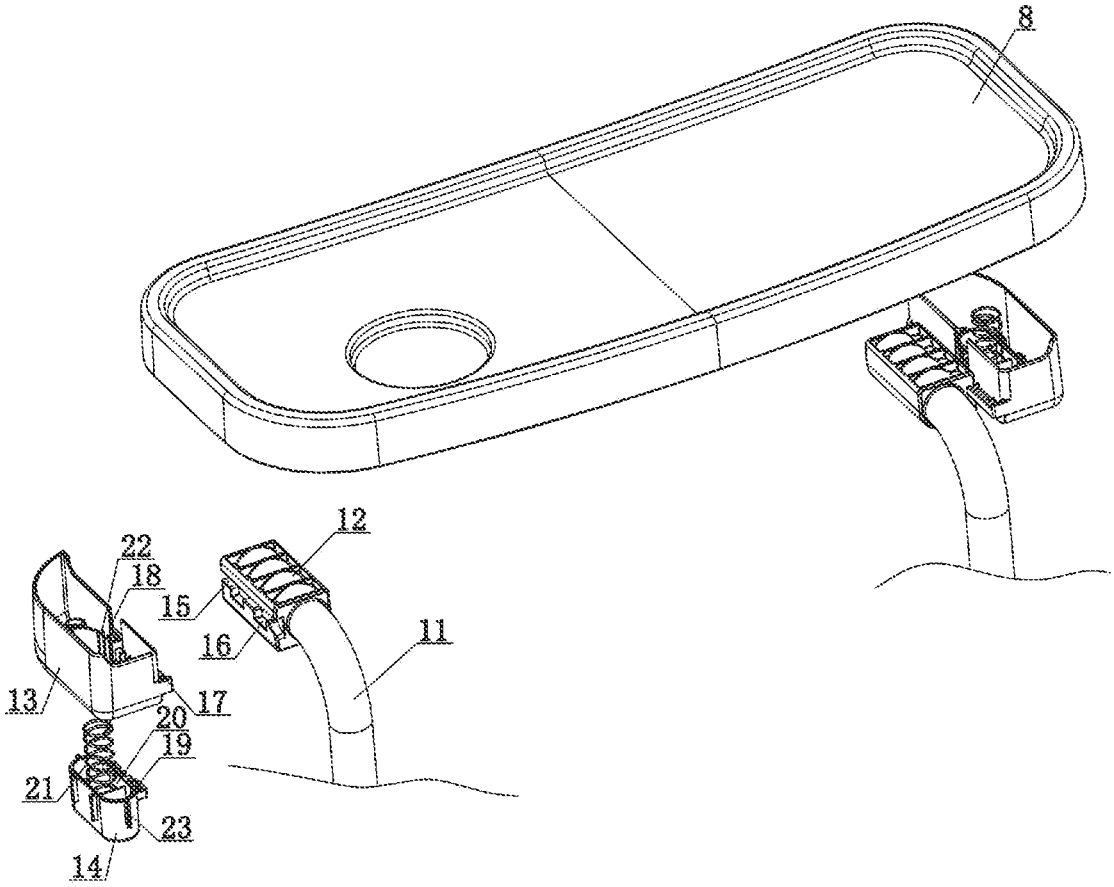
FIG. 6 is a structural decomposition diagram of a feeding tray, a button box, and a bending rod of the utility model.

Referring to FIGS. 5 and 6, the feeding tray 8 can be adjusted in multiple front and rear positions. Each of the tops of the front two support rods 1 is provided with the bending rod 11, and the feeding tray base 12 is sleeved on the outer periphery of the bending rod 11. The bottom of the feeding tray 8 is fixedly provided with two button boxes 13 with an opening at the top, and each button box 13 corresponds to the feeding tray base 12 on one bending rod 11. The elastic button 14 is arranged in the button box 13, and the bottom of the button 14 extends out of the bottom of the button box 13. Each of both sides of the feeding tray base 12 is provided with the slide slot 15 and two clamping slots 16 arranged at an interval. The two clamping slots 16 are located below the slide slot 15 and are communicated with the slide slot 15. A side of the button box 13 is provided with the guide rail 17 and the notch 18, and the guide rail 17 is located in the slide slot 15. A side of the button 14 is provided with the clamping portion 19, and one end of the clamping portion 19 passes through the notch 18 and is located in the clamping slot 16.

Figure 7:
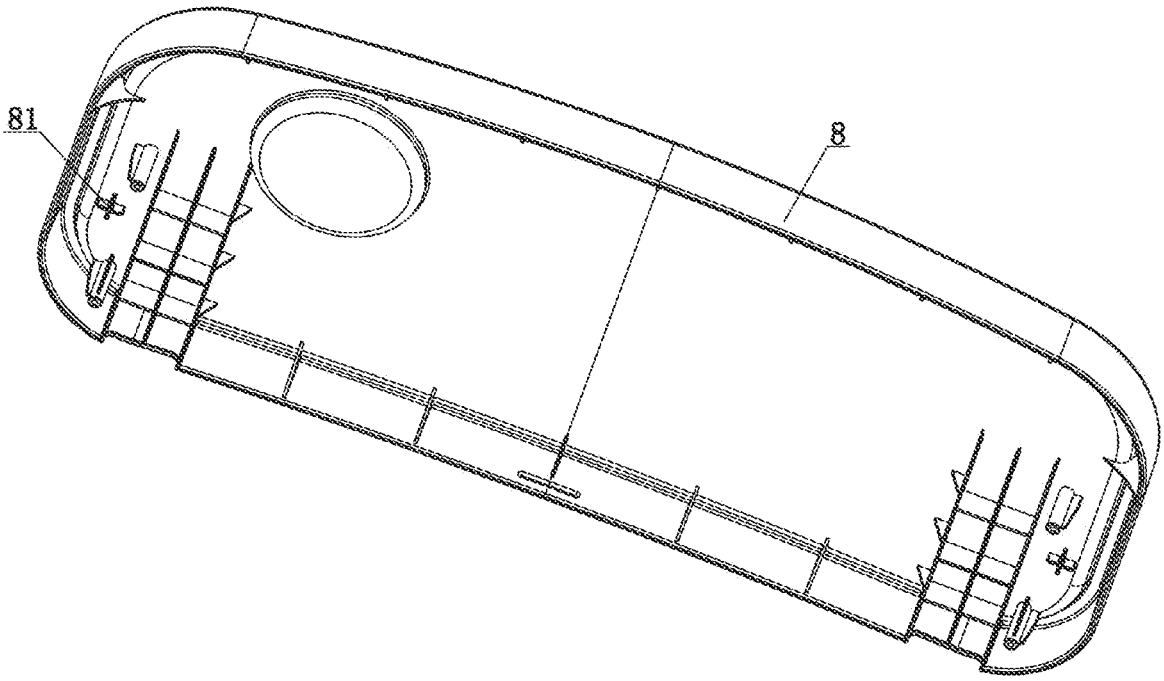
FIG. 7 is a structural diagram of the feeding tray of the utility model.

Referring to FIGS. 5 to 7, the spring groove 20 is arranged in the button box 13, and the bottom of the feeding tray 8 is provided with the spring sleeve column 81. The spring 21 is arranged in the spring groove 20, and the top of the spring 21 is sleeved on the outer periphery of the spring sleeve column 81. The inner peripheral surface of the button box 13 is provided with a plurality of guide grooves 22, and the outer periphery of the button 14 is provided with a plurality of guide bars 23. Each guide bar 23 corresponds to one guide groove 22 and is located in the guide groove 22. The guide bars 23 and the guide grooves 22 cooperate with each other to provide a guiding and limiting function for the upper and lower sliding of the button 14.

Referring to FIGS. 5 and 6, when the feeding tray 8 needs to be adjusted in front and rear positions, the button 14 is pressed to separate the clamping portion 19 from the original clamping slot 16, and at this time, the feeding tray 8 and the button box 13 can slide forward and back. When the feeding tray 8 slides to the desired position, the button 14 is released to allow the clamping portion 19 to re-snap into the new clamping slot 16. If the feeding tray 8 needs to be removed, the button 14 is pressed directly, and then the feeding tray 8 is directly pulled to slide forward.

Figure 8:
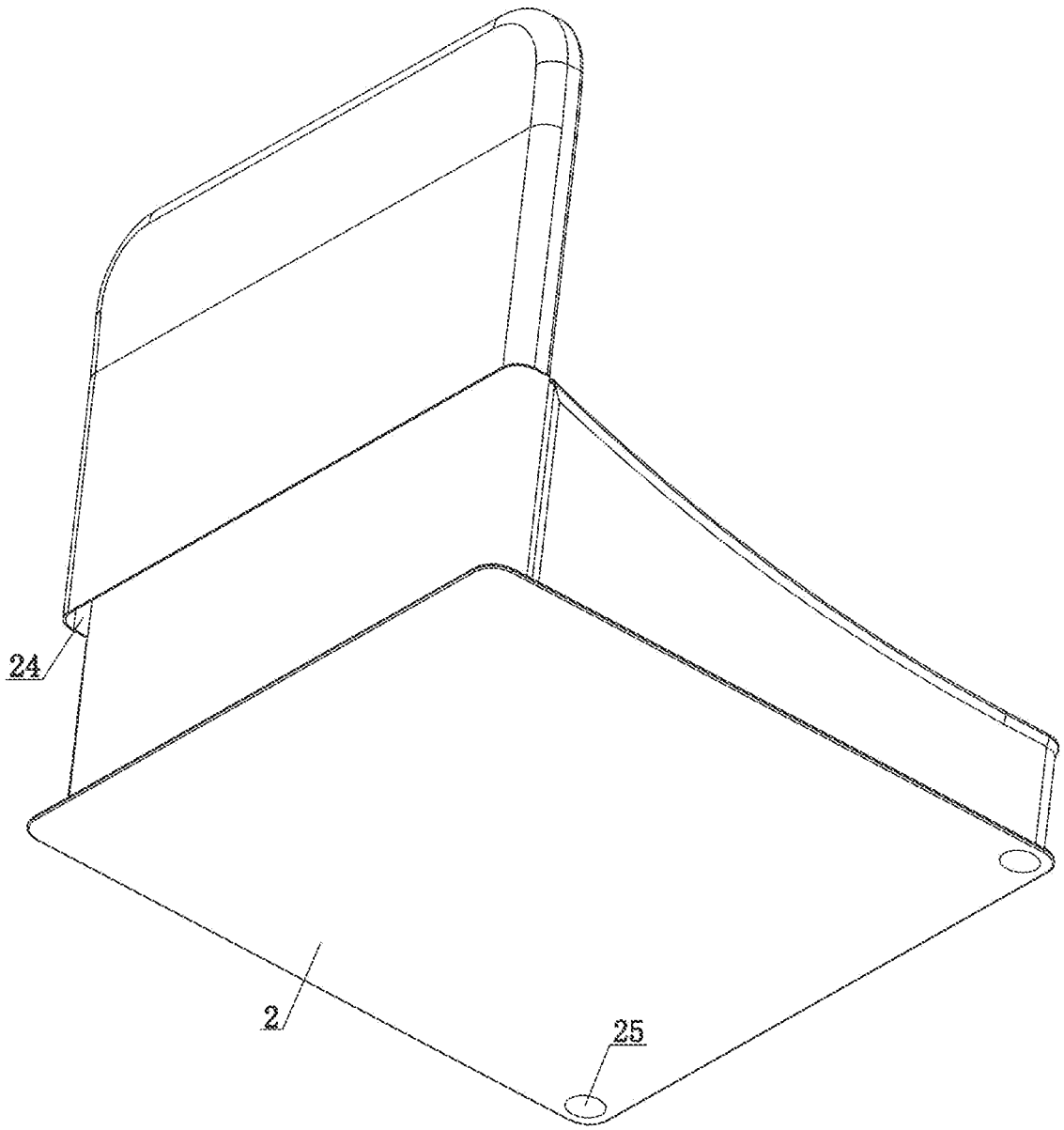
FIG. 8 is a structural diagram of a cloth seat of the utility model.
Figure 9:
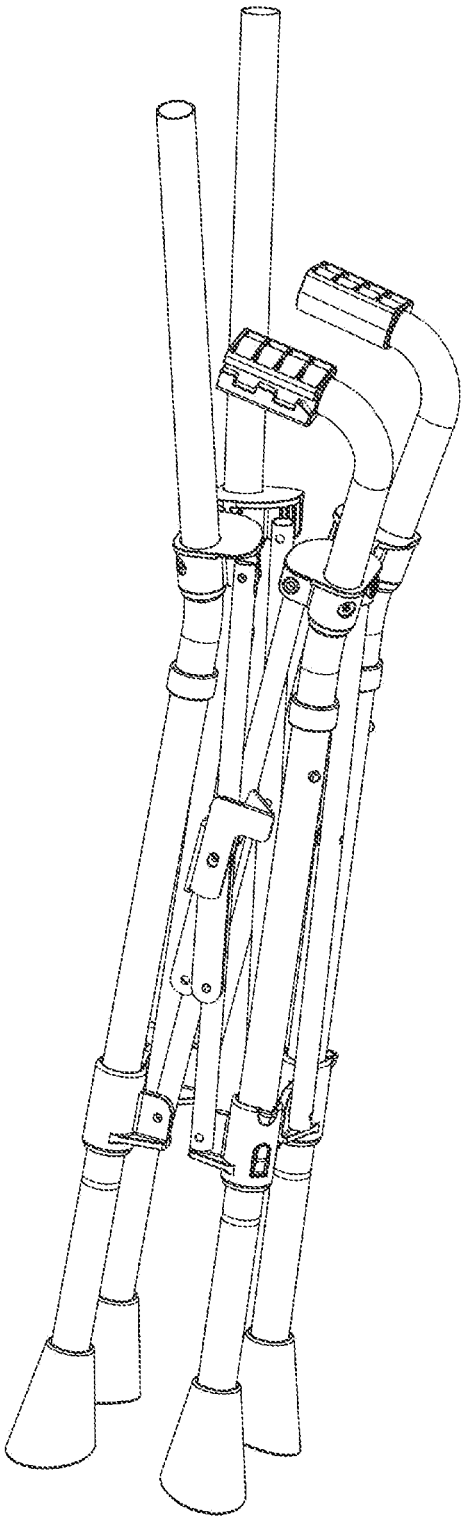
FIG. 9 is a structural diagram of the support rod and the folding rod after being folded of the utility model.

Referring to FIGS. 1 and 8, the rear end face of the cloth seat 2 is provided with the accommodation slot 24 into which the rear two support rods 1 are allowed to extend. The front end of the cloth seat 2 is provided with two rod holes 25 through which the front two support rods 1 are allowed to pass. When the cloth seat 2 is connected to the four support rods 1, the corresponding support rods 1 are directly inserted into the accommodation slot 24 and the rod holes 25.

The above described are merely specific implementations of the present invention, but the design concept of the present invention is not limited thereto. Any non-substantial changes made to the present invention based on the concept of the present invention should fall within the protection scope of the present invention.

What is claimed is:

1. A foldable highchair, comprising four support rods distributed at four corners and a cloth seat; wherein a hinge base and a slide base are sleeved on each of the four support rods; the four support rods form four groups of adjacent two support rods; two folding rods intersected with each other are arranged between the adjacent two support rods in each group of the four groups, and the two folding rods are hinged at an intersection; a first end of each of the two folding rods is hinged with the corresponding hinge base, and a second end of each of the two folding rods is hinged with the corresponding slide base; a double-locking mechanism configured to control the two folding rods to be fixed or folded is arranged on the two folding rods between the adjacent two support rods in a first group of the four groups; the slide base on each of the adjacent two support rods in a second group of the four groups is provided with an opening slot, and an elastic column is arranged in each of the adjacent two support rods in the second group; one end of the elastic column extends out of each of the adjacent two support rods in the second group and snaps into the opening slot; the cloth seat is connected to the four support rods, and a removable feeding tray is arranged between tops of front two support rods of the four support rods;

wherein the double-locking mechanism comprises a first locking piece, a second locking piece, and a third locking piece arranged sequentially from inside to outside; wherein a first end of the first locking piece is hinged with a first support rod of the four support rods, a first end of the second locking piece is hinged with a second support rod of the four support rods, and a second end of the first locking piece and a second end of the second locking piece are hinged with the third locking piece; a top surface of the first locking piece is provided with a cover piece; the third locking piece is in a shape of "]", and a bottom of the third locking piece is provided with an inclined hook portion; a bottom surface of the cover piece abuts a top surface of the second locking piece and a top surface of the third locking piece; the inclined hook portion hooks on a bottom surface of the second locking piece, and the third locking piece is configured to be moved.

2. The foldable highchair according to claim 1, wherein the second end of the first locking piece is provided with a first hinge hole, and the second end of the second locking piece is provided with a second hinge hole; a transverse portion of the third locking piece is provided with a third hinge hole; the first locking piece, the second locking piece, and the third locking piece are hinged by allowing a pin shaft to pass through the first hinge hole, the second hinge hole, and the third hinge hole; and a size of the third hinge hole is larger than a size of the first hinge hole and a size of the second hinge hole.

3. The foldable highchair according to claim 1, wherein an elastic button piece is arranged in the opening slot; a V-shaped elastic piece is arranged in each of the adjacent two support rods in the second group; the V-shaped elastic piece is provided with the elastic column, and the elastic column abuts the elastic button piece.

4. The foldable highchair according to claim 1, wherein a limiting member is fixedly arranged on each of the four support rods, and the limiting member is located above the slide base.

5. The foldable highchair according to claim 1, wherein a rear end face of the cloth seat is provided with an accommodation slot, wherein rear two support rods of the four support rods are allowed to extend into the accommodation slot; and a front end of the cloth seat is provided with two rod holes, wherein the front two support rods are allowed to pass through the two rod holes.

6. A foldable highchair, comprising four support rods distributed at four corners and a cloth seat; wherein a hinge base and a slide base are sleeved on each of the four support rods; the four support rods form four groups of adjacent two support rods; two folding rods intersected with each other are arranged between the adjacent two support rods in each group of the four groups, and the two folding rods are hinged at an intersection; a first end of each of the two folding rods is hinged with the corresponding hinge base, and a second end of each of the two folding rods is hinged with the corresponding slide base; a double-locking mechanism configured to control the two folding rods to be fixed or folded is arranged on the two folding rods between the adjacent two support rods in a first group of the four groups; the slide base on each of the adjacent two support rods in a second group of the four groups is provided with an opening slot, and an elastic column is arranged in each of the adjacent two support rods in the second group; one end of the elastic column extends out of each of the adjacent two support rods in the second group and snaps into the opening slot; the cloth seat is connected to the four support rods, and a removable feeding tray is arranged between tops of front two support rods of the four support rods;

wherein the removable feeding tray is configured to be adjusted in multiple front and rear positions;

wherein each of the tops of the front two support rods is provided with a bending rod, and a feeding tray base is sleeved on an outer periphery of the bending rod; a bottom of the removable feeding tray is fixedly provided with two button boxes, wherein a top of each button box of the two button boxes is provided with an opening, and the each button box corresponds to the feeding tray base on one bending rod; an elastic button is arranged in the each button box, and a bottom of the elastic button extends out of a bottom of the each button box; each of both sides of the feeding tray base is provided with a slide slot and two clamping slots arranged at an interval; the two clamping slots are located below the slide slot and are communicated with the slide slot; a side of the each button box is provided with a guide rail and a notch, and the guide rail is located in the slide slot; a side of the elastic button is provided with a clamping portion, and one end of the clamping portion passes through the notch and is located in the clamping slot.

7. The foldable highchair according to claim 6, wherein a spring groove is arranged in the each button box, and the bottom of the removable feeding tray is provided with a spring sleeve column; a spring is arranged in the spring groove, and a top of the spring is sleeved on an outer periphery of the spring sleeve column; an inner peripheral surface of the each button box is provided with a plurality of guide grooves, and an outer periphery of the elastic button is provided with a plurality of guide bars; and the plurality of guide bars correspond to and are located in the plurality of guide grooves, respectively.

* * * * *